US005119996A

United States Patent [19]

Stahlecker

[11] Patent Number: 5,119,996

[45] Date of Patent: Jun. 9, 1992

[54] SPINNING MACHINE FOR DOUBLE YARN

[75] Inventor: Fritz Stahlecker, Bad Überkingen, Fed. Rep. of Germany

[73] Assignee: Hans Stahlecker, Fed. Rep. of Germany; a part interest

[21] Appl. No.: 795,304

[22] Filed: Nov. 20, 1991

Related U.S. Application Data

[63] Continuation of Ser. No. 496,923, Mar. 21, 1990, abandoned.

[30] Foreign Application Priority Data

Mar. 22, 1989 [DE] Fed. Rep. of Germany ..... 3909422

[51] Int. Cl.[5] ..... D01H 5/00; D01H 5/28; D01H 9/00; B65H 54/00

[52] U.S. Cl. ..... 242/42; 242/18 PW; 242/35.6 R; 57/269; 57/279; 57/328

[58] Field of Search ..... 242/18 PW, 35.6 R, 42; 57/22, 261, 263, 268, 269, 278, 279, 299, 328

[56] References Cited

U.S. PATENT DOCUMENTS

| | | | |
|---|---|---|---|
| 3,282,516 | 11/1966 | Porter | 242/18 PW |
| 4,466,575 | 8/1984 | Husges et al. | 242/18 PW |
| 4,501,116 | 2/1985 | Schuller et al. | 57/263 |
| 4,535,944 | 8/1985 | Nakahara et al. | 57/263 |
| 4,545,193 | 10/1985 | Tanaka et al. | 57/328 X |
| 4,687,148 | 8/1987 | Schuller et al. | 242/18 PW |
| 4,761,946 | 8/1988 | Stahlecker | 57/328 |
| 4,833,874 | 5/1989 | Stahlecker et al. | 57/268 X |
| 4,964,268 | 10/1990 | Stahlecker | 57/22 X |

FOREIGN PATENT DOCUMENTS 3634464 4/1988 Fed. Rep. of Germany .

*Primary Examiner*—Daniel P. Stodola
*Assistant Examiner*—Michael R. Mansen
*Attorney, Agent, or Firm*—Evenson, Wands, Edwards, Lenahan & McKeown

[57] ABSTRACT

A spinning machine is disclosed which includes a plurality of spinning units which each spin two prestrengthened yarn components and guide them together to a double yarn. A movable servicing device is provided which can be applied to the individual spinning units and which, for feeding the double yarn to a spool tube inserted into a spinning unit wind-up device and driven to perform rotations, has a device that can be applied to the spool tube and is equipped with devices for the deflecting of a section of the double yarn into a direction extending approximately in parallel to the axis of the spool tube and for the transferring of the deflected section of the double yarn into the moving range of a driving device rotating together with the spool tube.

13 Claims, 3 Drawing Sheets

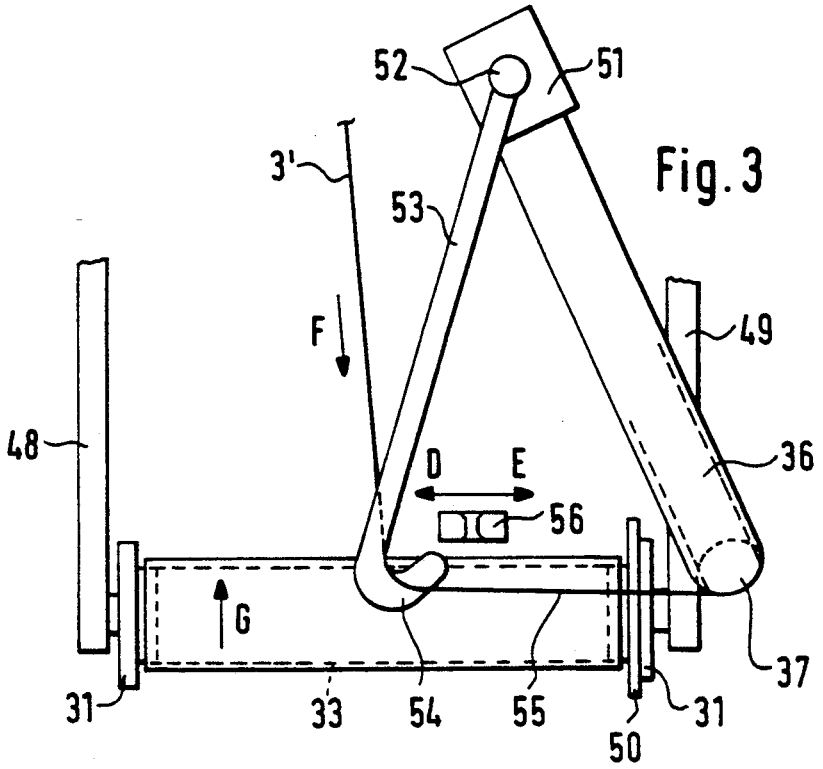
Fig. 3
Fig. 4
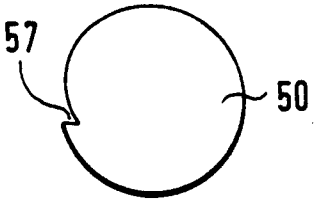
Fig. 5
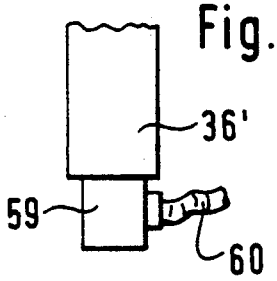
Fig. 6
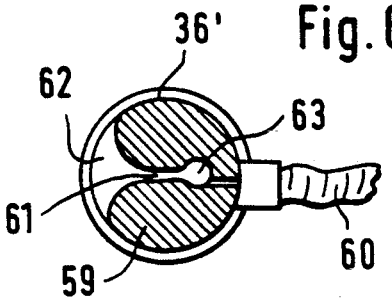

SPINNING MACHINE FOR DOUBLE YARN

This is a continuation of U.S. application Ser. No. 07/496,923, filed Mar. 21, 1990 now abandoned.

BACKGROUND AND SUMMARY OF THE INVENTION

The invention relates to a spinning machine having a plurality of spinning units which each spin two prestrengthened yarn components and which contain devices for guiding the yarn components together to form a double yarn and a wind-up device for winding up the double yarn into a package, and having devices for picking up a double yarn newly spun after a package spool change and for applying it to an empty spool tube.

It is known from German Published Examined Patent Application (DE-A 36 34 464), after a package spool change, to grip a double yarn newly spun at a spinning unit by means of a suction gripper and guide it to an empty spool tube. The double yarn is wound around the empty spool tube which subsequently is connected to the drive of the wind-up device so that the winding-up begins for forming a package.

An object of the invention is to develop a spinning machine of the initially mentioned type such that, after a package spool change, an automatic resumption of the spinning operation can be carried out.

This object is achieved in that a movable servicing device which can be applied to the individual spinning units is provided which, for feeding the double yarn to the spool tube inserted into the wind-up device and driven to perform rotations, contains a device that can be applied to the spool tube which is equipped with devices for deflecting a section of the double yarn into a direction which is approximately parallel to the shaft of the spool tube and for transferring this deflected section of the double yarn into the moving range of a driver rotating together with the spool tube.

By means of this development, it becomes possible, after a package spool change, to feed a newly spun double yarn fully automatically to a spool tube and thus to restart the wind-up operation. In this case, the circumstance is taken into account that only prestrengthened yarn components are present which must not be subjected to any high stress because otherwise there is the risk of a yarn breakage.

In a further development of the invention, it is provided that the servicing device is equipped with a swirl nozzle which can be applied to the moving path of the double yarn and can be acted upon by a pressure medium. This swirl nozzle is expediently actuated during the whole picking-up and feeding of the double yarn to the spool tube so that the double yarn during this handling can be strengthened beyond its normal resistance to tearing.

Other objects, advantages and novel features of the present invention will become apparent from the following detailed description of the invention when considered in conjunction with the accompanying drawings.

BRIEF DESCRIPTION OF THE DRAWINGS

FIG. 3 is a partial view of the area of a wind-up device during the feeding of the newly spun double yarn to the empty spool tube;

FIG. 4 is a detail of FIG. 3;

FIG. 5 is a view of the mouth area of a suction gripper which is equipped with a swirl nozzle; and FIG. 6 is an enlarged sectional view of the swirl nozzle of FIG. 5.

DETAILED DESCRIPTION OF THE DRAWINGS

Figure 1:
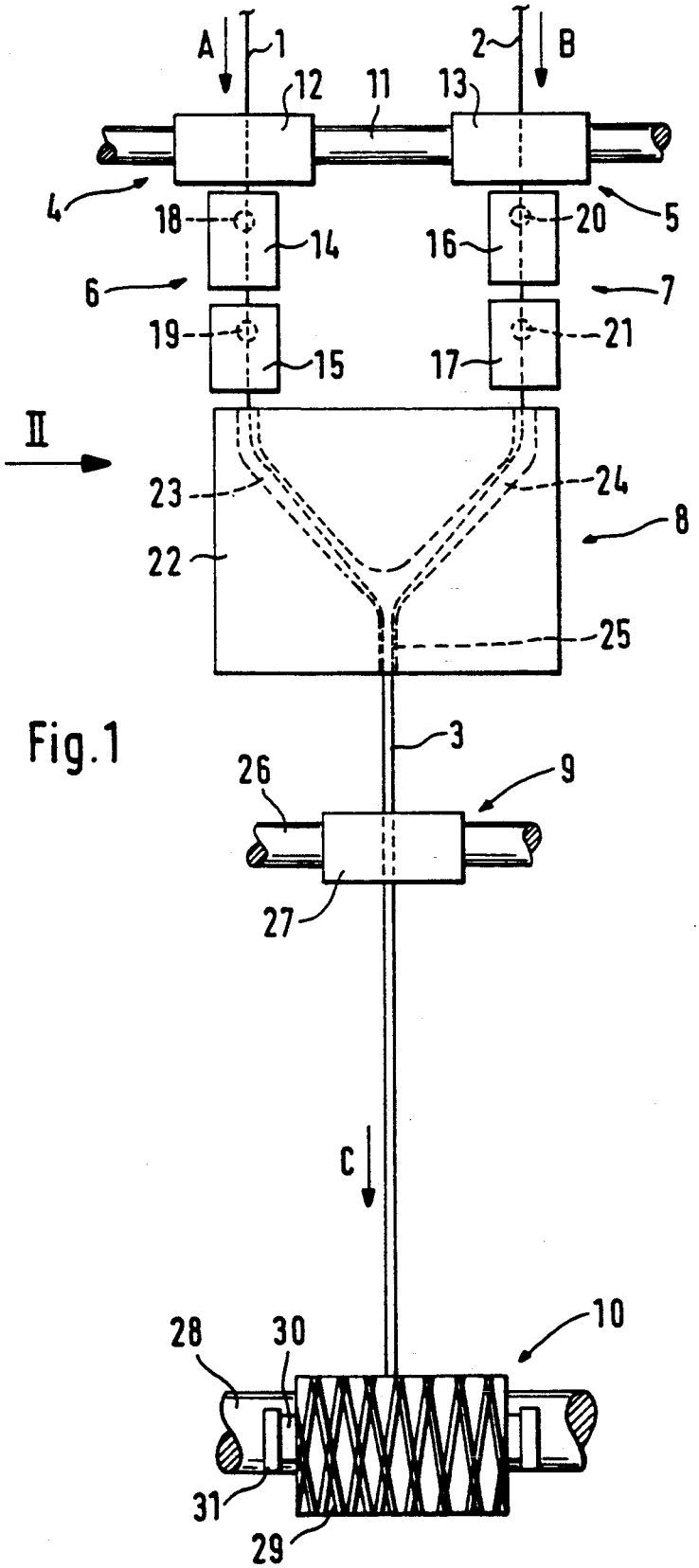
FIG. 1 is a frontal view of an individual spinning unit of a spinning machine in the operative condition, constructed according to a preferred embodiment of the invention.
Figure 2:
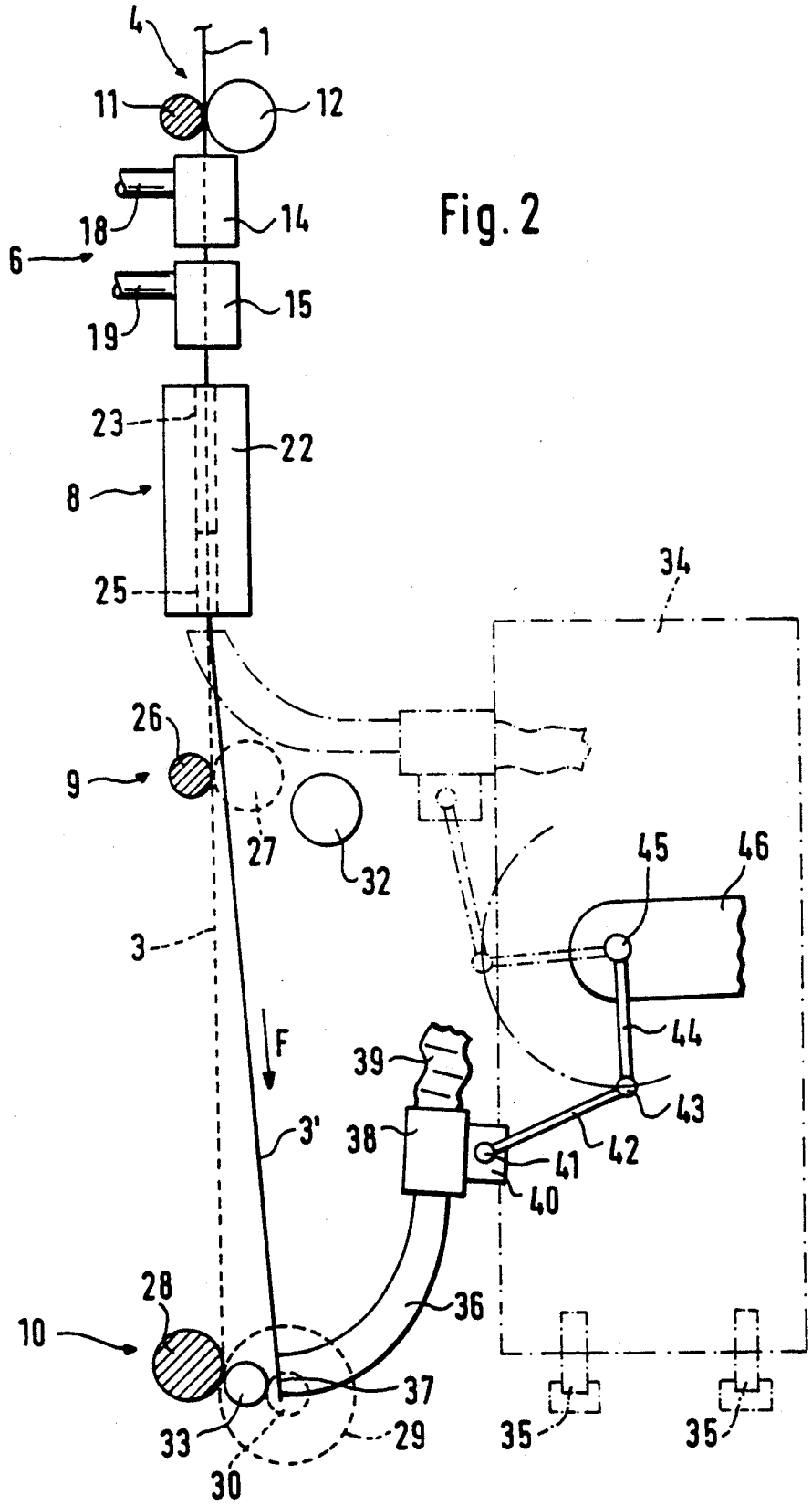
FIG. 2 is a view of the spinning unit of FIG. 1, showing the same while a newly spun double yarn is fed to an empty spool tube.

In FIG. 1 and 2, a spinning unit of a spinning machine is shown which is equipped with a plurality of such spinning units in a row next to one another. At each spinning unit, two prestrengthened yarn components 1, 2 are spun which are guided together to form a double yarn 3 which, as a double yarn, is wound side-by-side onto a spool package 29. Subsequently, the spool package 29 is fed to a twisting arrangement in which the double yarn 3 is processed to a type of twisted yarn.

Each spinning unit contains two drafting units 4, 5 of which only the pairs 11, 12; 11, 13 of delivery rollers are shown. The yarn components 1, 2 pass through the drafting units 4, 5 as slivers which are drawn to the desired yarn size in the drafting units 4, 5.

The two drafting units 4, 5 are followed by pneumatic false-twisting devices 6, 7 in which the two yarn components 1, 2 are prestrengthened by pneumatic false twisting. The pneumatic false-twisting devices 6, 7 each contain two air nozzles 14, 15, 16, 17 arranged behind one another which are connected to compressed-air lines 18, 19, 20, 21. The respective first air nozzle 14, 16 is constructed as an intake nozzle while the respective second air nozzle 15, 17 is constructed as a twisting nozzle.

The prestrengthened yarn components 1, 2 leaving the air nozzles 15, 17 arrive in a yarn guiding device 8 in which the yarn components 1, 2 are guided together to form a double yarn 3. This yarn guiding device 8 consists essentially of a plate 22 which has yarn guiding ducts 23, 24, 25 arranged in a y-shape.

The double yarn 3 leaving the yarn guiding device 8 is withdrawn by a withdrawal device 9 which consists of a withdrawal shaft 26 extending through in the longitudinal direction of the machine and of a pressure roller 27 pressed against it, which is held by means of a holding device which is not shown and can be swivelled into position 32 which is shown in FIG. 2.

After being processed by the withdrawal device 9, the double yarn 3 moves on to a wind-up device 10 which winds the double yarn 3 into a cross-wound package 29 on a spool tube 30. The spool tube 30 is held clamped between two spool plates 31 of a spool frame (FIG. 3) having two arms 48, 49. In a known manner, the spool frame can be swivelled around a shaft extending in the longitudinal direction of the machine so that the package 29 and the spool tube 30 can be swivelled away from a winding roller 28 extending through in the longitudinal direction of the machine and driven at the machine end and can be swivelled toward this winding roller 28. In the area of the package 29, the winding roller 28 has a driving area for the package 29 and the spool tube 30 which has a larger diameter than the winding roller 28. A cross-winding yarn guide 56 which is shown in FIG. 3 is also provided with respect to the wind-up device 10. This cross-winding yarn guide 56 moves back and forth in front of the package 29 or the spool tube 30 carrying out a cross-winding to-and-fro motion, deflecting the double yarn 3 correspondingly so that a cross-wound package 29 is wound. In addition, a compensating device, which is not shown, is assigned to the wind-up device 10 and provides that the different lengths of the moving path of the double yarn 3 which occur during the cross-winding movement are compensated, without the occurrence of unacceptable tension peaks in the double yarn 3.

During a package spool change, i.e., when the package 29 has reached the given diameter or the given wound-up yarn length, the spinning unit is switched off so that the continued supply of the double yarn 3 is interrupted. The full package 29 is taken out of the spool frame and is replaced by an empty spool tube 33 (FIG. 2, 3). Subsequently, the spinning operation is resumed. The then newly produced double yarn 3 is directed to the empty spool tube 33, which is already being driven by the winding roller 28 to perform rotations, and the winding-up into a package starts again. The slowing-down of the full package 29 and the inserting of an empty spool tube 33 can be carried out manually or by an automatic servicing device 34, as known from the state of the art.

The servicing device 34, which is shown in FIG. 2 by a dash-dotted line, is equipped with a suction gripper 36 which, by means of a coupling piece 38, is connected to a suction pipe 39. The coupling piece 38 has a holding part 40 which is connected by way of a joint 41 to a lever 42 which, in turn, is connected by way of a joint 43 with a second lever 44 which is held by way of a joint 45 at a holding device 46 of the servicing device 34. A drive, which is not shown, is assigned to the articulated levers 42, 44. By means of the actuating of this drive, the suction gripper 36, between the dash-dotted position, in which it is assigned to the outlet of the guiding device 8, can be applied to the empty spool tube 33 inserted in the spool frames 48, 49. By means of its mouth 37, the suction gripper 36 picks up the double yarn 3 at the guiding device 8. The double yarn 3 will then move in the direction of the arrow (F) and take up the position 3' shown in FIGS. 2, 3. In the position shown by means of drawn-out lines, the suction gripper 36 with its mouth 37 will already be located in the range of the empty spool tube 33.

A yarn guide 53 is assigned to the suction gripper 36 and has a hook-shaped finger 54 which grips the double yarn 3' entering into the mouth 37 of the suction gripper 36. The yarn guide 53 is fastened pivotally around a shaft 52 to a holding part 51 of the suction gripper 36. In this case, it is provided that either the suction gripper 36 or the yarn guide 53, after being applied to the empty spool tube 33 inserted in the spool frames 48, 59, carries out a movement which extends essentially in longitudinal direction of the spool tube 33 and in parallel to its axis. As a result, by means of the double yarn 3' entering into the mouth 37 of the suction gripper 36, a section 55 is formed which extends essentially in parallel with respect to the spool tube 33. This section 55 is brought into the range of a catching plate 50 which is mounted at one of the spool plates 31. The catching plate 50 rotates with the empty spool tube 33, moving with a component (G) in the direction opposite the moving direction (F) of the fed double yarn 3'. By means of a notch 57, the catching plate 50 grips the section 55 of the double yarn 3' and takes it along. In this case, the double yarn 3, is withdrawn from the finger 54 of the yarn guide 53 directed at the empty spool tube 33 and is fed to the empty spool tube 33. This starts the wind-up operation. The part of the double yarn 3' which entered into the suction gripper 36, in this case, is also withdrawn by the empty spool tube 33 and wound up on it, thus forming a yarn reserve. The length of this yarn reserve may, for example, be limited by assigning a cutting device to the suction gripper 36. This cutting device, which is not shown, after a given period of time cuts off the double yarn 3' withdrawn out of the suction gripper 36.

As shown in FIG. 2, the pressure roller 27 of the withdrawal device 9 is in position 32 when the suction gripper 36 is applied to the yarn guiding device 8. The suction gripper 36 which is arranged on running wheels 35 of the movable servicing device 34 when it moves to the empty spool tube 33, places the yarn in the range of the withdrawal device 9 which will then be closed again by moving the pressure roller 27 back into the operative position shown by the interrupted line.

Since the double yarn 3' consists of two only prestrengthened yarn components 1, 2, it does not have a very high resistance to tearing. It may therefore be advantageous to strengthen the double yarn 3' during the manipulation by means of the suction gripper 36 in such a manner that it has a higher resistance to tearing during this time. In a first embodiment, it is provided for this purpose that a swirl nozzle 59 is connected in front of the suction gripper 36' which is shown in FIG. 5, this swirl nozzle 59 being connected to a compressed-air pipe 60.

The swirl nozzle 59 shown in sectional view in FIG. 6 has a yarn guiding duct 63 which is connected to the compressed-air pipe 60 by means of a tangential blowing duct. The yarn guiding duct 63, by way of a threading-in and threading-out slot 61, is open toward the outside, the outer area 62 of this slot 61 being rounded off in a hopper shape. This swirl nozzle 59, which swirls the two yarn components 1, 2 of the double yarn 3 together and strengthens them, may be arranged in the range of the mouth of the suction gripper 36' and may move along with it. However, in this case, only the double yarn 3' is strengthened which enters into the suction gripper 36'.

In another embodiment, it is provided that the swirl nozzle 59 is carried by an independent application mechanism of the servicing device 34 and, together with the suction gripper 36, or after the suction gripper 36 has moved away from this area, is applied to the yarn guiding device 8. In this case, a strengthening of the double yarn 3' can be carried out by means of the actuating of the swirl nozzle 59 during the whole period of feeding the double yarn 3' to the spool tube 33.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning units which each spin two prestrengthened yarn components and which contain guiding devices for guiding the prestrengthened yarn components together to form a double yarn and a wind-up device for winding up the double yarn side-by-side onto a package at a spool tube which contains a yarn catching device, and a movable servicing device which can be selectively applied to the individual spinning units, said servicing device including:

a suction gripper which can be applied to a respective guiding device at a spinning unit to simultaneously grip the two newly spun yarn components, a suction gripper moving device for moving the suction gripper and two newly spun yarn components held thereby from the guiding device to the wind-up device of the respective spinning unit, and a movable yarn deflecting device operable for deflecting a section of the double yarn into a direction which is approximately parallel to the axis of the package spool tube with this deflected section being disposed into the travel path of the catching device which rotates along with the spool tube.

2. A spinning machine according to claim 1, wherein the movable yarn deflecting device has a hook-shaped guiding finger which points to the circumference of the spool tube when in an operable position at the wind-up device for the deflecting of a section of the double yarn.

3. A spinning machine according to claim 2, wherein the servicing device is provided with a swirl nozzle which can be applied to the moving path of the double yarn and can be acted upon by a pressure medium to thereby strengthen the double yarn for further facilitating the initiation of winding on the wind-up device.

4. A spinning machine according to claim 2, wherein the wind-up device contains a spool frame with spool plates receiving the spool tube between one another, one of the spool plates being provided with a driving plate.

5. A spinning machine according to claim 1, wherein the servicing device is provided with a swirl nozzle which can be applied to the moving path of the double yarn and can be acted upon by a pressure medium to thereby strengthen the double yarn for further facilitating the initiation of winding on the wind-up device.

6. A spinning machine according to claim 5, wherein the wind-up device contains a spool frame with spool plates receiving the spool tube between one another, one of the spool plates being provided with a driving plate.

7. A spinning machine according to claim 1, wherein the wind-up device contains a spool frame with spool plates receiving the spool tube between one another, one of the spool plates being provided with a driving plate.

8. A spinning machine according to claim 1, wherein the movable yarn deflecting device is carried by the suction gripper.

9. A spinning machine according to claim 8, wherein the yarn deflecting device is pivotally mounted at the suction gripper.

10. A spinning machine according to claim 9, wherein the yarn deflecting device is provided with a swivel drive.

11. A spinning machine according to claim 9, wherein the wind-up device contains a spool frame with spool plates receiving the spool tube between one another, one of the spool plates being provided with a driving plate.

12. A spinning machine according to claim 8, wherein the servicing device is provided with a swirl nozzle which can be applied to the moving path of the double yarn and can be acted upon by a pressure medium to thereby strengthen the double yarn for further facilitating the initiation of winding on the wind-up device.

13. A spinning machine according to claim 8, wherein the wind-up device contains a spool frame with spool plates receiving the spool tube between one another, one of the spool plates being provided with a driving plate.

* * * * *